United States Patent [19]

Sugiura et al.

[11] 4,030,468

[45] June 21, 1977

[54] IGNITION SYSTEM FOR INTERNAL COMBUSTION ENGINES

[75] Inventors: Noboru Sugiura, Ibaraki; Yasunori Mori, Hitachi; Seiji Suda, Mito, all of Japan

[73] Assignee: Hitachi, Ltd., Japan

[22] Filed: Mar. 18, 1976

[21] Appl. No.: 667,952

[30] Foreign Application Priority Data

Apr. 2, 1975 Japan ..... 50-39154

[52] U.S. Cl. ..... 123/148 E; 315/209 T

[51] Int. Cl.[2] ..... F02P 1/00

[58] Field of Search ..... 123/148 E; 315/209 R, 315/209 T, 224

[56] References Cited

UNITED STATES PATENTS

| | | | |
|---|---|---|---|
| 3,575,154 | 4/1971 | Taylor | 123/148 E |
| 3,605,713 | 9/1971 | LeMasters et al. | 123/148 E |
| 3,762,383 | 10/1973 | Richards et al. | 123/148 E |
| 3,838,672 | 10/1974 | Richards et al. | 123/148 E |
| 3,892,219 | 7/1975 | Preiser et al. | 123/148 E |

*Primary Examiner*—C. J. Husar
*Assistant Examiner*—Andrew Dolinar
*Attorney, Agent, or Firm*—Craig & Antonelli

[57] ABSTRACT

In an ignition system wherein an ignition timing signal generated in synchronism with the engine rotation is detected by a detecting transistor and a base current of a power transistor adapted to control a primary current of an ignition coil is controlled by the detected ignition timing signal thereby to generate a high voltage across a secondary side of the ignition coil; the primary current of the ignition coil is controlled by the power transistor not to exceed a predetermined value, a time interval during which the primary current of the ignition coil is restricted to the predetermined value is detected by a change in collector voltage of the power transistor, i.e. an output thereof, and a conduction starting point for the primary current of ignition coil is controlled by the output of the power transistor.

6 Claims, 4 Drawing Figures

IGNITION SYSTEM FOR INTERNAL COMBUSTION ENGINES

This invention relates to a contactless ignition system wherein a maximum primary current of an ignition coil is restricted.

Conventionally, in order to protect an ignition coil and make constant a voltage induced across secondary coil of the ignition coil, a measure has been proposed wherein a maximum primary current of the ignition coil is restricted and a conduction starting point of the primary current is controlled, as described by Paul D. Le Masters U.S. Pat. No. 3,605,713. To give a reference for the primary current restriction and the conduction starting point control, it was a general practice to connect in series a reference resistor to the primary side of the ignition coil and detect a voltage developing across the reference resistor.

An inexact control for the primary current conduction starting point of the ignition coil results in the following disadvantages. With a retarded conduction starting time for primary current, the primary current of the ignition coil becomes insufficient at the instant of ignition, bringing about insufficiency of the voltage to be induced across the secondary side of ignition coil or of spark duration. On the other hand, under the condition of an excessively early conduction starting time of the ignition coil for primary current, a duration during which the primary current of ignition coil is restricted to a maximum value becomes long. Since an electromagnetic energy to be stored at the primary side of the ignition coil is determined dependent upon the quantity of primary current, the longer becomes the duration during which the primary current is restricted to a maximum value, the more a wasteful current consumption not particularly in the spark discharge energy increases. Such an increase in current consumption accelerates heat generations at the ignition coil and inside a control transistor for controlling the primary current of the ignition coil with the result that current capacities of these elements are unnecessarily increased.

For the reasons set forth above, it is very important to control accurately the conduction starting point for the primary current of the ignition coil. The conventional measure, however, encountered considerable difficulties for an accurate control of the conduction starting point. This is because the conduction starting point for the primary current was controlled by a voltage developing across a reference resistor connected in series with the primary side of the ignition coil.

Studying variations in the primary current of the ignition coil, it is noticed that an incremental rate of the primary current in accordance with lapse of time is large at the conduction starting point but gradually decreases as the current increases. On the other hand, the conduction starting point for the primary current of the ingition coil is controlled by merely detecting a magnitude of the primary current around a maximum current value to be restricted. Accordingly, it follows that the time control is carried out by detecting a voltage corresponding to a transient current undergoing a small incremental rate in accordance with the lapse of time. Under this condition, there arise many difficulties for improving accuracy in the detection of conduction starting point. For example, a highly accurate control of the primary current conduction starting point poses the task of taking into consideration precision of the current detecting resistor, temperature variation thereof, the detection accuracy of a voltage detector for detecting voltages across the current detecting resistor and the like factors.

When further detailed problems are taken into account, an extremely accurate control of the maximum primary current of the ignition coil is advantageous in that the current capacity of the ignition coil can be reduced and stabilization of voltages induced across the secondary side can be expected. The conventional measure, however, performs the control of the conduction starting point of the primary current by merely detecting a voltage detecting across the resistor connected in series with the primary coil and hence suffers from difficulties. More particularly, when exceeding a reference value set for controlling a maximum current, the primary current of the ignition coil is controlled to be suppressed to a constant value. Accordingly, it is necessary to control the primary current conduction starting point at another reference value not exceeding the former reference value for controlling the maximum primary current. However, if a voltage corresponding to the latter reference is set to a value markably below the reference for the maximum primary current control, reduction in control accuracy results. Therefore, a strict adjustment of the reference voltages is of an important matter.

An object of this invention is to provide a contactless ignition system which assures an excellent control of the conduction starting point for the primary current of an ignition coil.

Another object of the invention is to provide an ignition system capable of accurately detecting a duration during which the ignition coil primary current is restricted by a power transistor.

Another object of the invention is to provide an ignition system which provides a restriction value of the ignition coil primary current insensitive to temperature variations.

Yet another object of the invention is to provide an ignition system capable of accurately controlling the conduction starting point of the primary current of the ignition coil.

According to the invention, in order that a duration during which a maximum of the primary current of ignition coil is so controlled by a power transistor as to be suppressed to a predetermined value is minimized, it is intended to detect a duration during which the primary current of the ignition coil is prohibited from increasing by the power transistor. A transient increase of the ignition coil primary current is detected by a separate detecting means. As the primary current of the ignition coil exceeds a reference value, the base current of the power transistor is suppressed thereby to restrict increase of the primary current of the ignition coil. For this, the power transistor shifts from a saturated operation to non-saturated operation. By detecting the shift, a conduction starting point of the primary current of the ignition coil is controlled such that a duration for the non-saturated operation, i.e., a duration which starts from an instant that the power transistor shifts from the saturated operation to nonsaturated operation and terminates at an instant that the primary current of the ignition coil is cut off to generate a high voltage across the secondary side, approximates to zero.

Figure 1:
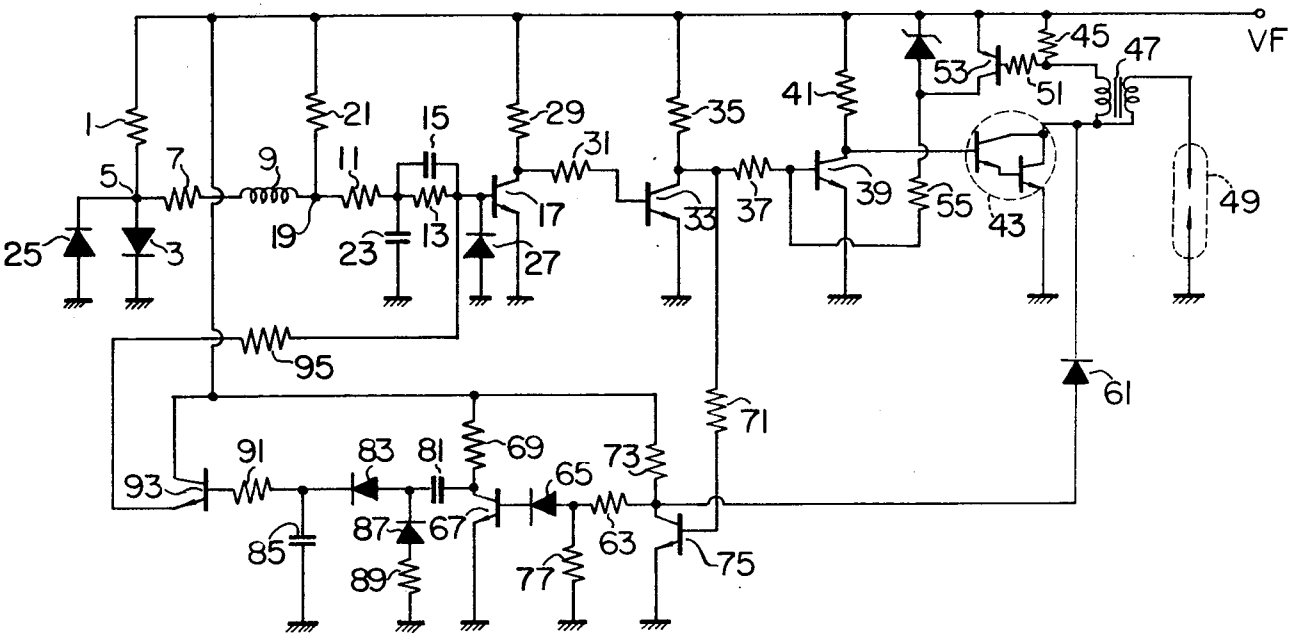
FIG. 1 is a circuit diagram of one embodiment of the invention.

With reference to the accompanying drawings, one embodiment of the invention will be described. In FIG. 1, a D.C. voltage V.F. is applied across a resistor 1 and diode 3 connected in series, and a voltage appearing at a juncture 5 is applied to a base of transistor 17 through a resistor 7, a pick-up coil 9, resistor 11 and resistor 13 shunted with a capacitor 15. A current flows into a juncture 19 between the pick-up coil 9 and the resistor 11 through a resistor 21. A forward voltage drop across the diode 3 is almost constant and made slightly larger than a base-emitter voltage drop of a transistor 17. An ignition timing signal in synchronism with a rotation of an engine crank is generated at the pick-up coil 9. Resistances of the resistors 7, 11, 13 and 21 are so adjusted as to allow a small amount of base current to flow through the transistor 17 under the condition that a null voltage is generated at the pick-up coil 9.

The generated voltage at the pick-up coil 9 is measured from the reference potential at the juncture between the pick-up coil 9 and the resistor 7. By this, it follows that the transistor 17 operates stably even when the number of revolutions of the engine is small, that is, an output voltage of the pick-up coil 9 is low. A capacitor 23 is adapted to remove noise. A diode 25 connected in parallel with the diode 3 is adapted to protect the diode 3 from a reverse voltage applied thereacross. Further, a diode 27 is for preventing a reverse voltage from being applied between the base and emitter of the transistor 17.

The base current of transistor 17 causes a collector current to flow through a resistor 29. A change in collector voltage of the transistor 17 caused thereby is applied to a transistor 33 through a resistor 31 so that a collector current flows through a resistor 35. This causes a change in collector voltage of the transistor 33 which is transmitted to a base of transistor 39 through a resistor 37. Thus, a collector current of the transistor 39 flows through a resistor 41 to control a power transistor 43 in Darlingtion connection. The transistor 43 controls a current flowing though a primary coil of an ignition coil 47, and a spark is produced at an ignition plug 49.

A voltage across a resistor 45 is made proportional to the primary current of the ignition coil 47 and applied to a base of transistor 53 through a resistor 51. A collector current of the transistor 53 is applied to the base of the transistor 39 through a resistor 55 so that the power transistor 43 operates to suppress a maximum primary current of the ignition coil 47 to a predetermined value.

A diode 61 adapted to detect a non-saturated operation of the power transistor 43 in which the primary current of the ignition coil 47 is prevented from increasing is connected through a resistor 63 and diode 65 to a base of transistor 67 with a collector resistor 69 connected thereto. One end of the resistor 63 is connected with a collector of a transistor 75 having a base resistor 71 and a collector resistor 73.

The D.C. voltage V.F. is applied through the resistor 69 to a series connection of a capacitor 81, diode 83 and capacitor 85 to charge the capacitors 81 and 85. When the transistor 67 is turned on, an electric charge stored in the capacitor 81 is discharged through a resistor 89 and a diode 87. The voltage across the capacitor 85 is applied through a resistor 91 to a base of transistor 93 and consequently, through the transistor 93 is passed a collector current responsive to that voltage, which collector current produces a voltage across a resistor 95 to be applied to the base of the transistor 17.

Figure 2:
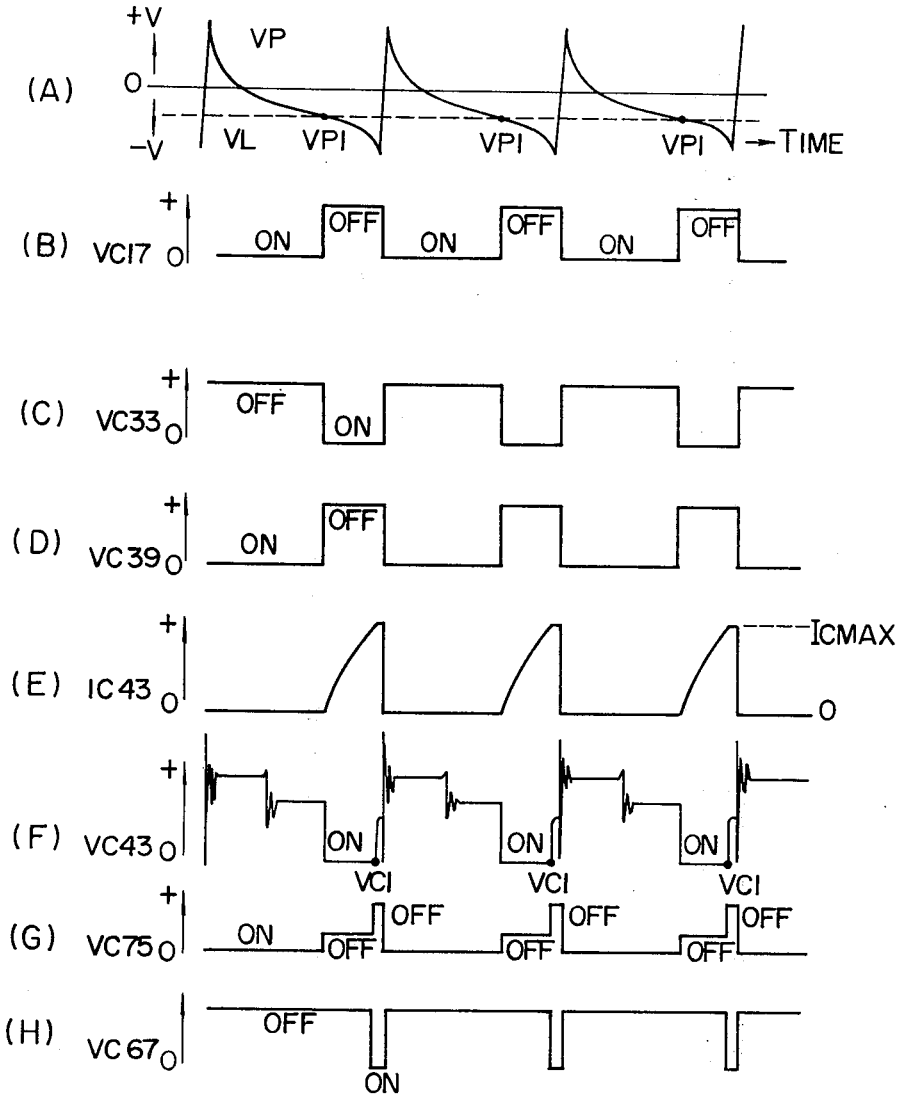
FIG. 2 shows waveforms useful to explain the embodiment of FIG. 1.

Referring now to FIG. 2 showing waveforms, the embodiment of FIG. 1 will be detailed. Generated across the electromagnetic pick-up coil 9 is an ignition timing signal VP as shown in FIG. 2(A). Under the condition that a null current flows into the transistor 93 and resistor 95 and the capacitor 15 is emptied of electric charge, the transistor 17 is turned on in positive state of the ignition timing signal VP whereas it is turned off in a negative state of the timing signal. The operating level of the transistor 17 is inherently determined by the baseemitter forward voltage thereof, but in this circuit it is actually determined according to the output of the pick-up coil 9 and the charging voltage across the capacitor 85. While the engine is in operation, since a current flows into the transistor 93 and the resistor 95, an apparent operating level VL for the transistor 17 is shifted toward negative. Therefore, when a potential at the juncture 19 falls below the apparent operating level VL, the transistor 17 is turned off. FIG. 2(B) shows a collector voltage VC 17 of the transistor 17. With a collector voltage of higher level, the transistor 33 becomes conductive to disable the transistor 39. Collector voltages of the transistor 33 and the transistor 39 are shown in FIGS. 2(C) and 2(D), respectively. With the transistor 39 rendered non-conductive, the power transistor 43 becomes conductive so that a current starts flowing into the ignition coil 47. At this instant, a sufficient current is supplied to the base of transistor 43 and the transistor 43 continues to operate in saturated condition.

A condition starting point for the primary current of the ignition coil 47 is determined in accordance with an instant that the potential of the ignition timing signal VP falls below the apparent operating level VL of the transistor 17. Accordingly, an early conduction starting point results from a high operating level VL, and a retard conduction starting point from a low operating level VL. At such a conduction starting point, the primary current of the ignition coil 47 starts rising in accordance with a time constant determined by the resistor 45, the ignition coil 47 and the transistor 43. This transient current is detected as a voltage across the resistor 45 which in turn is applied to the base of transistor 53. When the transient current reaches a reference value IC MAX, the base-emitter potential difference of transistor 53 exceeds a threshold so that the collector current of the transistor 53 is caused to flow into the base of the transistor 39 through the resistor 55 to decrease the collector potential of the transistor 39 and thus the base current of the power transistor 43. In other words, the transistor 53 and the current detecting resistor 45 establish a feedback circuit. The transistor 43 shifts from the saturated operation to non-saturated operation thereby to restrict the primary current of the ignition coil to a substantially predetermined constant value. As the restriction against the primary current occurs, a voltage developing across the primary coil on the basis of a self-inductance of the ignition coil 47 decreases abruptly. For example, the primary current suppressed to a constant value brings about nullification of a voltage component due to the self-inductance of the primary coil of the ignition coil 47 and leaves behind only a voltage component developing on the basis of a voltage drop due to an inner resistance of the primary coil, the latter voltage component undergoing an abrupt reduction. On the other hand, the emitter-collector voltage of the power transistor 43 increases abruptly, together with an abrupt increase in the collector current of the feedback transistor 53. That is to say, as the power transistor 43 shifts from the saturated operation to the non-saturated operation, the voltage across the primary coil of ignition coil decreases abruptly and the emitter-collector voltage increases abruptly. These changes in the voltages suppress the primary current of the ignition coil to a predetermined value and it is possible by the non-saturated operation of the power transistor 43 to detect the restriction against increase of the primary current of the ignition coil.

The diode 61 picks up the increased collector-emitter voltage of the power transistor 43 so that the collector potential of the transistor 75 is increased. The increased collector potential is divided by the resistors 63 and 77 thereby to make conductive the transistor 67 through the diode 65. With the saturated operation of the power transistor 43 by which the collector potential of the transistor 75 is suppressed to a low value through the diode 61, the transistor 67 is rendered cut off.

As shown in FIG. 2(F), the collector voltage VC 43 of the power transistor 43 increases abruptly at an instant owing to the non-saturated operation, accompanied by a simultaneous suppression against the increase of collector current. Concurrently as shown in FIG. 2(G), the collector potential VC 75 of the transistor 75 increases from a value related to the saturated collector potential of the transistor 43 to another value related to the non-saturated collector potential thereof. Also, the transistor 67 is rendered conductive as shown in FIG. 2(H). Thus, the electric charge stored in the capacitor 81 is discharged through the transistor 67, the resistor 89 and the diode 87. The duration for this discharge is determined by the duration for non-saturated operation of the power transistor 43 i.e., the duration during which the primary current of the ignition coil 47 is prevented from increasing. The longer becomes that duration, the more the electric charge stored in the capacitor 81 is discharged.

As the output of the pick-up coil 9 shown in FIG. 2(A) again rises above the apparent operating level VL of the transistor 17, the transistor 17 is turned on and the power transistor 43 is cut off. Concurrently, the transistor 33 is turned off, the transistor 75 is turned on and the transistor 67 is turned off. An increase in the collector voltage of transistor 67 thus produced causes the diode 83 to be biased forwardly and the diode 87 to be biased reversely. As a result, current flows into the capacitor 85 from the power source through the resistor 69, capacitor 81 and the diode 83. The magnitude of this current is inversely proportioned to the quantity of charge stored in the capacitor 81. Accordingly, the longer is the duration during which the increase in the primary current of the ignition coil 47 is restricted, the greater the charging current to the capacitor 85, making it possible to increase the voltage thereacross. With the charging current to capacitor 85 increased, the collector current of the transistor 93 is so controlled by the voltage across capacitor 85 as to decrease the apparent operating level VL of the transistor 17. As a result, the instant of cutting off the transistor 17 takes place later, thereby the conduction starting point of the ignition coil primary current determined by the power transistor 43 being delayed.

On the other hand, under the condition that the duration for restricting the increase of the primary current of the ignition coil 47 is very small or almost nullified, the capacitor 81 is almost prevented from discharging so that the charging current to the capacitor 85 is substantially prohibited. In this case, since the voltage across capacitor 85 gradually decreases with the base current which flows through the transistor 93, the apparent operating level of transistor 17 is elevated to quicken the conduction starting point of ignition coil primary current.

As described herein above, the conduction starting point of primary current of the ignition coil can be controlled by detecting the non-saturated operating duration of the power transistor 43.

In accordance with this invention, in order to control the conduction starting point of the primary current of the ignition coil 47, the increase in the primary current of the ignition coil is suppressed by the action of the power transistor 43 and a fluctuation created by the resultant abrupt decrease of electromotive force due to inductance of the ignition coil is picked up. Such fluctuation is large and easily detectable. The suppression against the increase of primary current is effected when the power transistor shifts from the saturated operation to non-saturated operation.

Further, in accordance with this invention, the conduction starting point of the ignition coil primary current is controlled by the duration during which the power transistor for controlling the primary current of the ignition coil operates in the non-saturated range in such a manner that the non-saturated operation period is decreased. Where temperature rise in the power transistor is concerned, heat generation per hour for the non-saturated operation is about ten times as such as that for the saturated operation. Therefore, detecting the non-saturated operation period and controlling the conduction starting point of the primary current such that the non-saturated operation period is approximately nullified plays an important role in suppressing temperature rise in the power transistor.

The saturated to non-saturated operation shift can be detected by sensing an increase in the collector-emitter voltage of the power transistor, decrease in the voltage across the ignition coil or fluctuation in collector current or collector voltage of the feedback transistor for restricting the primary current of the ignition coil.

The embodiment of FIG. 1 will be described hereunder more specifically. In this embodiment, an incremental collector voltage of the power transistor is detected through the diode 61. Since the incremental collector voltage can be picked up as a positive potential relative to ground, this signal itself can conveniently be used as a control signal for the subsequent transistor, for example a base current of the transistor 67. An anavanche diode is used for the diode 61. This type of diode operates under the application of a reverse high voltage and then returns to a normal diode operation when the high voltage is removed. Therefore, this diode cannot be damaged by a surge voltage developing at the primary side of the ignition coil in response to ignition phenomenon. A Zener diode may be substituted for the avalanche diode.

Figure 3:
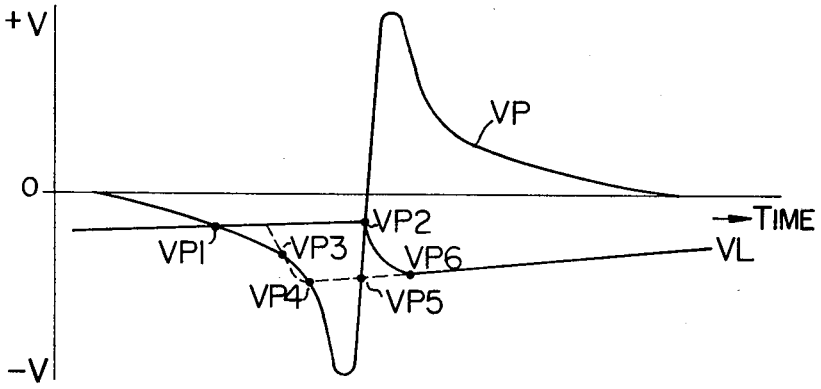
FIG. 3 is a waveform explaining a relation between the pick-up coil output and operating level.

As mentioned above, the apparent operating level of the first stage transistor 17 in relation to the pick-up output is controlled by a charging voltage across the capacitor 85. The charging voltage varies when the power transistor becomes non-conductive in accordance with a non-saturated operating period. FIG. 3 shows the relation between the output VP of the pick-up coil 9 and apparent operating level VL of the transistor 17 determined by the output of the pick-up coil 9 and the charging voltage across the capacitor 85. The charge stored in the capacitor 85 will discharge through the transistor 93 so that the apparent level VL of the transistor 17 gradually increases in accordance with lapse of time. At the point $VP_1$, the transistor 17 is turned off to turn on the power transistor 43 and the primary current of ignition coil starts flowing. At a point $VP_2$, the transistor 17 is turned on to cut off the power transistor 43 and a spark is generated at the ignition plug 49. At the point $VP_2$, the transistor 67 which has been conducting is rendered cut off and a charging current is passed into the capacitor 85 through capacitor 81 so that the apparent operating level VL of the transistor 17 is decreased. As the capacitor 81 becomes fully charged, the charging current to the capacitor 85 diminishes and at a point $VP_6$, the capacitor 85 again gradually discharges through the transistor 93 to elevate the operating level of the transistor 17. In this embodiment, while the power transistor 43 stands cut off, the quantity of electric charge stored in the capacitor 85 is changed to a value in accordance with the non-saturated operating period of the power transistor.

In the figure, a dotted curve shows a change in the operating level when the power transistor 43 stands conductive, that is, when the capacitor 85 is directly charged during the non-saturated operation of the power transistor. In this case, the operating level VL of the transistor 17 sometimes intersects the pick-up signal VP twice, for example, at points $VP_3$ and $VP_4$ and the power transistor 43 stands cut off between the points $VP_3$ and $VP_4$. As a result, it is impossible to pass a sufficient quantity of the primary current to the ignition coil 47.

It is not preferable, as mentioned above, to detect the non-saturated operating period of the power transistor 43 so as to thereby directly charge and discharge the capacitor adapted to control the operating level of the transistor 17 since unstable operation of the power transistor results therefrom. Thus, there arises needs of providing a countermeasure for this. In view of the stable operation of the power transistor, it is desirable as in the embodiment to store an electric charge in the separate capacitor 81 temporarily and then transfer the electric charge to the capacitor used for controllingthe operating level during cut-off of the power transistor.

In the embodiment of FIG. 1, the power transistor 43 stands conductive with a signal of the pick-up coil 9 decreased below the apparent operating level. This relation, however, may be reversed. Namely, the same result can be obtained with an ignition system wherein an initial positive waveform derived from a pick-up coil 9 causes a primary current to flow into an ignition coil 47 and a subsequent negative output cuts off the primary current of ignition coil. In such case, the foregoing description related to FIG. 3 holds true, provided that polarities of voltages are inverted.

Figure 4:
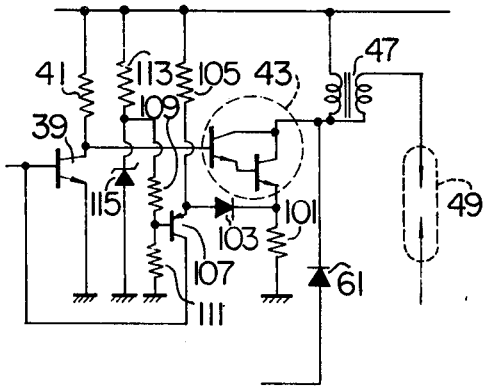
FIG. 4 is a circuit diagram of a modified feedback circuit for restricting a maximum primary current of the ignition coil.

The circuit for detecting and feedbacking the primary current of the ignition coil 47 shown in FIG. 1 can be modified as shown in FIG. 4. In FIG. 4, the detecting resistor 45 is replaced with a detecting resistor 101 connected between the emitter of the power transistor 43 and the ground. The transistor 53 is replaced with a transistor 107 whose base is maintained at a constant potential identical to a division of voltage across a Zener diode 115 by resistors 109 and 111. With a decremental current flowing through the resistor 101, the emitter potential of the transistor 107 is decreased through a diode 103, thereby the transistor 107 is cut off.

With an incremental current flowing through the resistor 101, on the other hand, a large voltage drop is generated thereacross to elevate the emitter potential of the transistor 107 above its base potential. As a result, a current is supplied from the power source to the base of the transistor 39 through the resistor 105 and the transistor 107 to decrease the base current of the power transistor 43, thereby suppressing the primary current of the ignition coil 47 to a predetermined value. With the feedback circuit of FIG. 4, the non-saturated operation of the power transistor 43 can also be detected through the diode 61 whose anode is connected to the collector of the transistor 75, as in the embodiment of FIG. 1.

The modification of FIG. 4 is advantageous in that the primary current of the ignition coil 47 can be detected without being influenced by temperature. More particularly, a summation of a voltage across the resistor 101 (referred to as voltage V 101) and a forward drop voltage across the diode 103 (referred to as voltage V 103) is applied to the emitter of the transistor 107, namely, $$\text{Voltage applied to emitter} = V\ 101 + V\ 103 \qquad (1).$$

A base voltage (referred to as voltage VB 107) of the transistor 107 is kept constant by the Zener diode 115 and the resistors 109 and 111. Further, a base-emitter potential difference required to allow the transistor 107 to pass therethrough an emitter current (and collector current) is referred to as voltage VE 107. Then, an emitter potential necessary for the emitter current flow of the transistor 107 is given by, $$VB\ 107 + VE\ 107 \qquad (2).$$

The condition for passing the feedback base current into the transistor 39 with the incremental voltage across resistor 101 and collector current flow through the transistor 107 is given by, $$VB\ 107 + VE\ 107 \quad V\ 101 + V\ 103 \qquad (3).$$

Assuming that the primary current of the ignition coil is maintained at a predetermined value by the action of feedback, expression (3) becomes, $$VB\ 107 + VE\ 107 \approx V\ 101 + V\ 103 \qquad (4).$$

It should be appreciated that the voltage V 101 across resistor 101 is insensitive to temperature variation, the forward drop voltage V 103 across diode 103 is sensitive to temperature and the forward emitter-base drop voltage VE 107 of the transistor 107 is also sensitive to temperature. Since the temperature characteristics of the emitter-base junction of the transistor 107 and the forward voltage drop thereacross are selected the same as those of the diode 103, VE 107 ≈ V 103 can be held and influences of temperature can be cancelled. Therefore, the base potential of the transistor 107 is so determined as to satisfy, $$VB\ 107 \approx V\ 101 \quad (5).$$

The base potential of transistor 107 has a value equal to a division of Zener voltage of the Zener diode 115 by the resistors 109 and 111. The Zener voltage itself is sensitive to temperature but the base potential VB 107 of the transistor 107 is immune to temperaturesince the Zener voltage is divided by the resistors 109 and 111 by about one-tenth. For a Zener voltage of 6 volts, for example, a base potential of the transistors 107 divided by the resistors 109 and 111 is maintained at 0.6 volts. Consequently, a temperature coefficient associated with the base potential is fractionized by one-tenth. In this manner, voltages VB 107 and V 101 are balanced to keep the balance between the base-emitter voltage of the transistor 107 and the voltage across the resistor 101, thereby influences of temperature being cancelled. As explained above, the circuit of FIG. 4 assures the suppression of the primary current of the ignition coil to a predetermined value.

Other measures may be taken for suppressing the primary current of the ignition coil to a predetermined value. To this end, for example, a plurality of diodes connected in series between the base and emitter of the power transistor may be forward biased.

What is claimed is:

1. In an ignition system for internal combustion engines comprising:

an ignition coil having at least a primary winding, a first transistor with a base, collector and emitter, a direct potential source, impedance means, first connecting means for connecting said primary winding of the ignition coil, said collector and emitter of said first transistor and said impedance means in series across said direct source, means for producing an alternating signal voltage in synchronism with an engine rotation, first control means having a predetermined operating voltage level for controlling the base current of said first transistor on the basis a relationship between the operating voltage level and the alternating signal voltage, and second control means for controlling the base current of said first transistor in response to a voltage across said impedance means to suppress primary current of said ignition coil to a predetermined value, the improvement which comprises first detecting means for detecting a duration during which said first transistor operates in a non-saturated region, and third control means for controlling the relation between the operating voltage level of said first control means and the alternating signal voltage in response to an output of said first detecting means, wherein the operating voltage level of said first control means shifts with respect to the alternating signal voltage in accordance with the non-saturated operating duration of said first transistor, for controlling the conduction starting time for the primary current of said ignition coil so as to decrease the non-saturated operating duration of said first transistor.

2. An ignition system according to claim 1, wherein said first detecting means comprises means for detecting a collector potential of said first transistor, first and second capacitors, first means for applying a signal derived out of said collector potential detecting means to said second capacitor for only a duration that a base current of said first transistor is caused to flow there through, a second means for applying a signal proportioned to the signal of said second capacitor to said first capacitor for a duration that said first transistor is turned off, whereby the operating level of said first transistor is shifted by said third control means in accordance with the signal of said first capacitor.

3. An ignition system according to claim 1, wherein said first detecting means comprises first input means for sensing a conductive state of said first transistor and second input means for sensing a collector-emitter voltage of said first transistor, thereby a duration which a base current of said first transistor is caused to flow there through by said first control means is detected by an input transmitted through said first input means and a non-saturated operating duration of said first transistor is detected by the input and an input transmitted through said second input means in combination.

4. An ignition system according to claim 3, wherein said first detecting means comprises first and second capacitors and charging means provided for said first capacitor, whereby a signal responsive to a non-saturated operating duration of said first transistor is stored in said second capacitor, current proportioned to the signal stored in said second capacitor is passed through said first capacitor when said first transistor is turned off, and the operating level of said first control means is shifted by said third control means in accordance with a voltage across said first capacitor.

5. An ignition system according to claim 4, wherein said first control means comprises a second transistor operable to switch in accordance with the alternating signal, the means for applying a bias current to the base of said second transistor, and means for varying the bias current in accordance with a voltage across said first capacitor.

6. An ignition system according to claim 3, wherein said second control means comprises a feedback transistor with its base maintained at a predetermined potential, and a diode connected between emitters of said feedback transistor and said first transistor, whereby the base current of said first transistor is controlled by a collector by a collector current of said feedback transistor.

* * * * *